United States Patent [19]

Cohen

[11] 4,000,573

[45] Jan. 4, 1977

[54] MARQUEE LETTERS

[75] Inventor: Sy Cohen, Los Angeles, Calif.

[73] Assignee: Visual Components, Inc., Canoga Park, Calif.

[22] Filed: Oct. 30, 1975

[21] Appl. No.: 627,441

[52] U.S. Cl. ..... 40/142 R; 40/143; 40/140

[51] Int. Cl.[2] ..... G09F 7/02

[58] Field of Search ..... 40/142 R, 143, 140, 40/125 R

[56] References Cited

UNITED STATES PATENTS

| | | | |
|---|---|---|---|
| 1,217,192 | 2/1917 | Larson et al. | 40/140 |
| 1,428,334 | 9/1922 | Knauber | 40/125 E |
| 1,445,861 | 2/1923 | Bültzingslöwen | 40/140 |
| 1,469,396 | 10/1923 | Schilling | 40/140 |
| 1,648,772 | 11/1927 | Lubarsky | 40/140 |
| 2,114,639 | 4/1938 | Preddey | 40/139 |
| 2,198,184 | 4/1940 | Stack | 40/140 |
| 3,574,964 | 4/1971 | Ownbey | 40/140 |
| 3,742,633 | 7/1973 | Palm | 40/133 B |

*Primary Examiner*—Louis G. Mancene
*Assistant Examiner*—John H. Wolff
*Attorney, Agent, or Firm*—Nilsson, Robbins, Dalgarn & Berliner

[57] ABSTRACT

Letters for use on a marquee are constructed with a tray-like member having a front panel cut through with an opening in the form of desired indicia. The tray includes a continuous integral rim for containing a translucent flexible color panel, providing color for the indicia. A lip is formed integrally coextensive with a side wall portion of the rim and extends laterally for overlap with the opposite side wall of an adjacent letter of like construction. Brackets connected to the side walls project rearwardly to secure the letter to the marquee and on the side opposite the overlap lip are spaced inwardly to accomodate the overlap lip of an adjacent letter. For particular indicia, a patch of opaque material of the same color as the front panel can be glued to the front surface of the color panel. In one embodiment, elongate frame members are provided coextensive with major length sections of the rim whereby the color panel may be retained by sliding between the frame members and the front panel. In another embodiment, the color panel is simply secured by adhesive to the front panel.

6 Claims, 6 Drawing Figures

FIG. 1
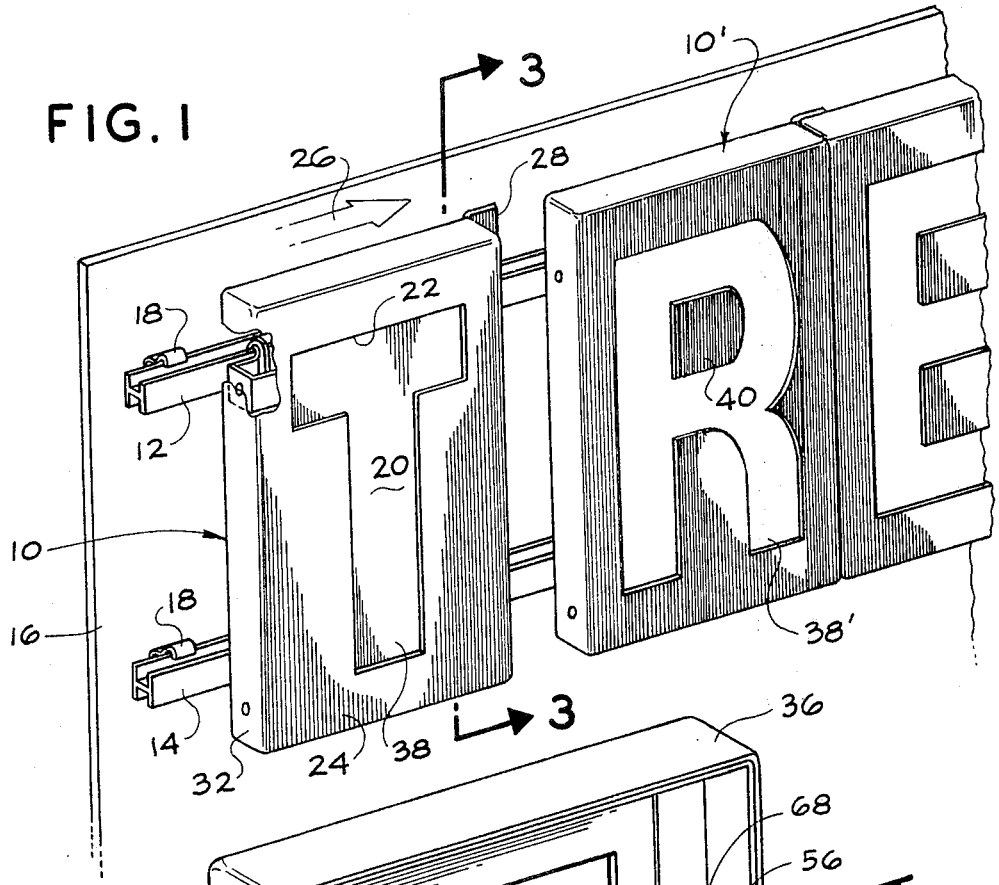
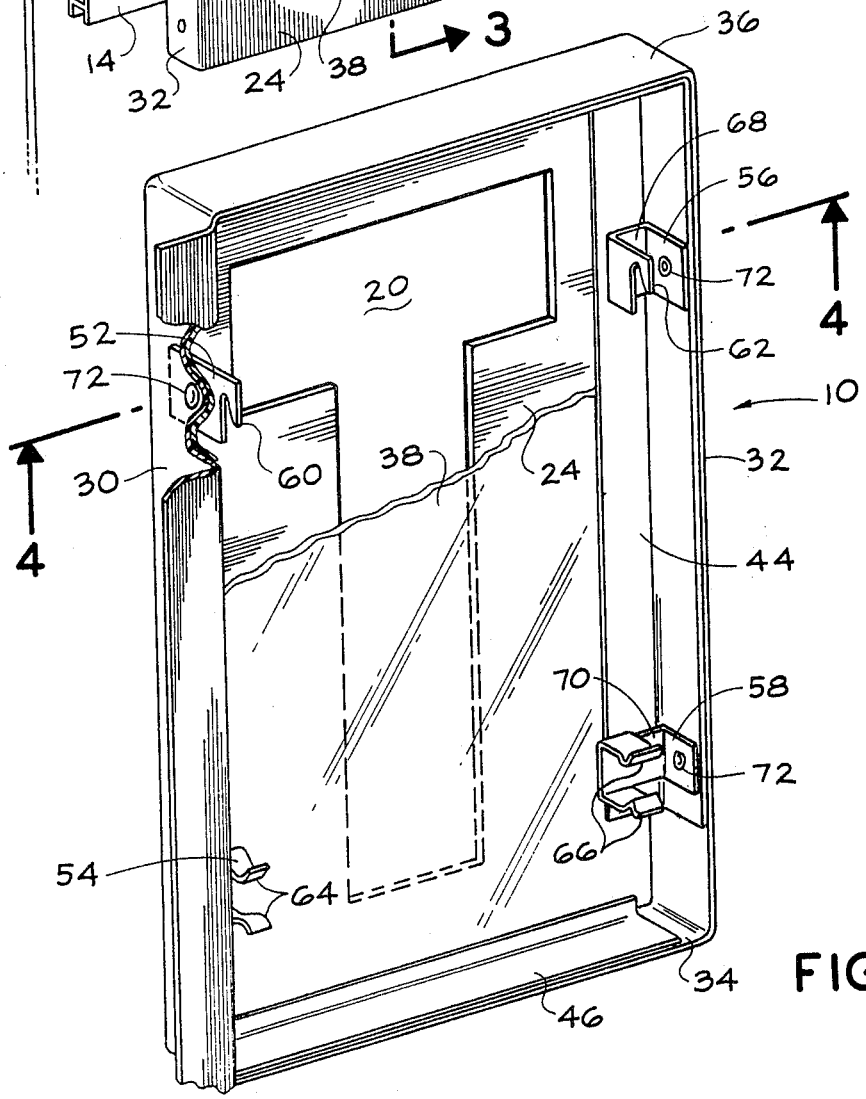
FIG. 2

FIG. 3
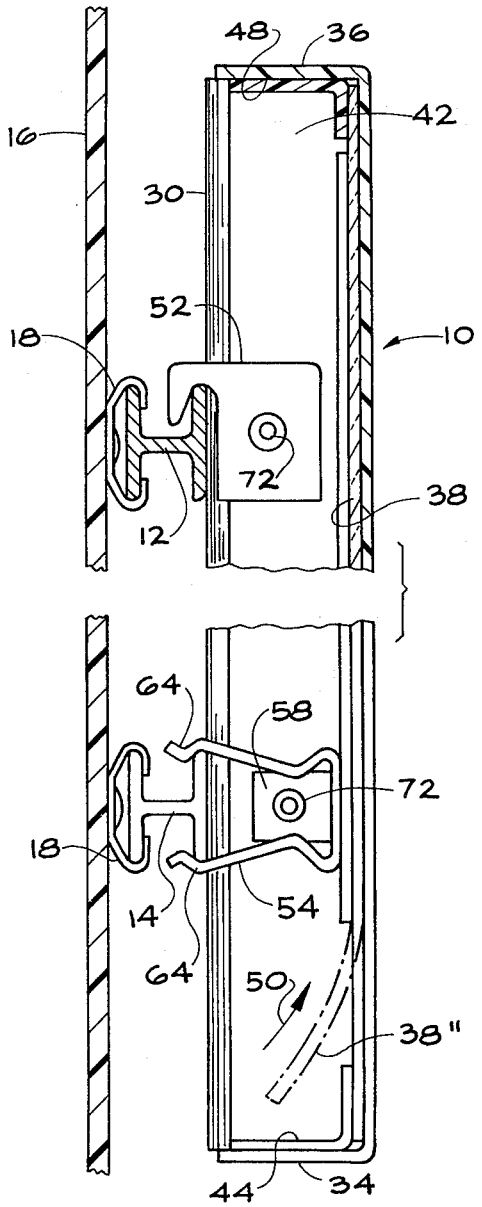
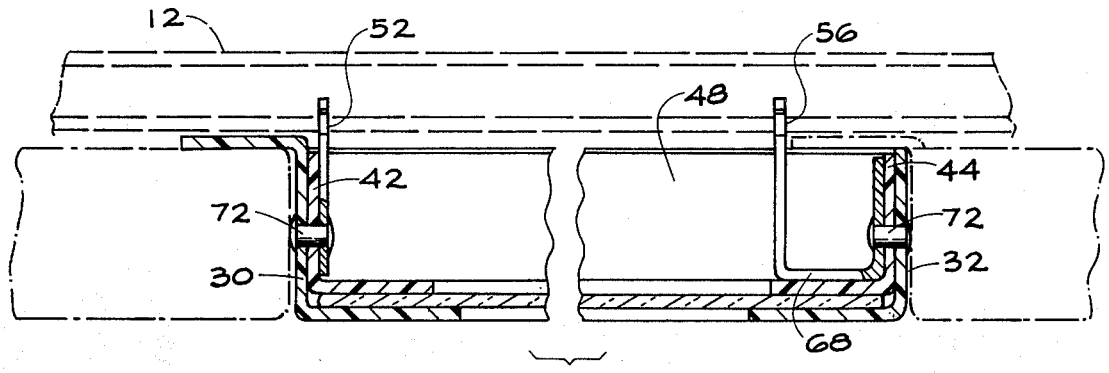
FIG. 4

MARQUEE LETTERS

FIELD OF THE INVENTION

The field of art to which the invention pertains includes the field of card, picture and sign exhibiting, particularly letter-forming signs with interchangeable letters.

BACKGROUND AND SUMMARY OF THE INVENTION

A common use heretofore made of relatively large interchangeable letters has been in marquee signs for such structures as motion picture houses, supermarkets, public buildings, large sign boards associated with a hotel or the like, and generally any marquee or marquee-type structure in which the information provided by the sign will require periodic changing but which must be sufficiently large so that it is viewable by a large number of people from a substantial distance. Commonly, such marquees and sign boards contain a plurality of horizontally running tracks on which plastic letters are hung. The letters are provided with brackets which project rearwardly therefrom and engage the tracks by hooks and/or by spring fingers or the like so that the letters can be readily placed on the sign, slid horizontally for easy location, and removed when desired. Typically such letters are each provided as a single unit having an outer shape in the form of the letter or other indicia and in a color which contrasts with the color of the marquee. Usually, the marquee is white and the letters are black or other contrasting color. Such marquees are often illuminated from behind with the light being diffused through the translucent material constituting the face of the marquee, and the letters stand out in contrast to such illumination. Other types of signs are known in which letters are provided as stencilled cutouts in uniformly rectangular plates. The letters can be seen by illumination through the cutout portions or by backing the cutout portions with a glass plate to soften the light passing through the openings in the letter. Such letters are placed in side by side relation on the marquee. It is also known to construct small signs using block or stencilled letters with interlocking side edges to block the transmission of light between the letters. While such interlocking letters can be advantageously utilized in small signs where the letters themselves can be contained within a frame they have not been directly applied to large marquees where suspension on horizontal tracks is required.

The present invention provides letters of the stencil type, that is where the letters are formed in a rectangular background by means of a cutout opening through a front panel. In accordance herewith, the letters are joined one with another in overlapping relation, but they are adapted for being suspended from a marquee with standard horizontal track construction. In a specific embodiment, additional advantage is obtained by providing for a replaceable color panel to back the stencilled front panel so that by simple replacement of the color panel, a letter of different color can be obtained.

More particularly, a letter is provided for use on a marquee comprising a tray-like member having a front panel, first and second side walls and at least a bottom wall integral with the side walls. The front panel is formed with an indicia opening therethrough and a color panel is secured rearwardly of the front panel for providing color for the indicia. The walls extend rearwardly from the front panel forming an integral continuous rim thereabout. An overlap lip is integrally coextensive with a side wall and extends laterally a substantial distance therefrom so as to provide overlap with the opposite side wall of an adjacent letter of like construction. Brackets are connected to the letter, each having a portion formed to engage the marquee, and project rearwardly of the front panel a distance exceeding the extent of the side walls. Importantly, the bracket adjacent the side wall opposite the wall bearing the overlap lip is spaced inwardly a distance sufficient to permit overlap with the lip of an adjacent letter of like construction.

The color panel is formed of a flexible but self-supporting sheet of substantially translucent rigid plastic. In the eventuality that a letter or other indicia requires that an opaque portion be suspended in a surrounding opaque portion, such as would occur with the letters A, B, D, O, P, Q and R, an appropriately shaped patch of the opaque material can be adhered to the forward surface of the color panel for location within the indicia opening.

In one embodiment, frame members releasably securing the color panel are formed by elongate flanges coextensive with major length sections of the side walls. In another embodiment, the color panel is simply secured by adhesive to the front panel.

BRIEF DESCRIPTION OF THE DRAWINGS

FIG. 1 is a front perspective view showing a portion of a marquee with horizontal track thereon and letters in accordance with one embodiment of the present invention, with a portion of one letter partially cut-away, mounted on the track;

FIG. 2 is a rear perspective view of one of the letters of FIG. 1 with a portion partially cut-away;

FIG. 3 is a cross-sectional view on line 3—3 of FIG. 1;

FIG. 4 is a cross-sectional view on line 4—4 of FIG. 2;

DETAILED DESCRIPTION

Figure 5:
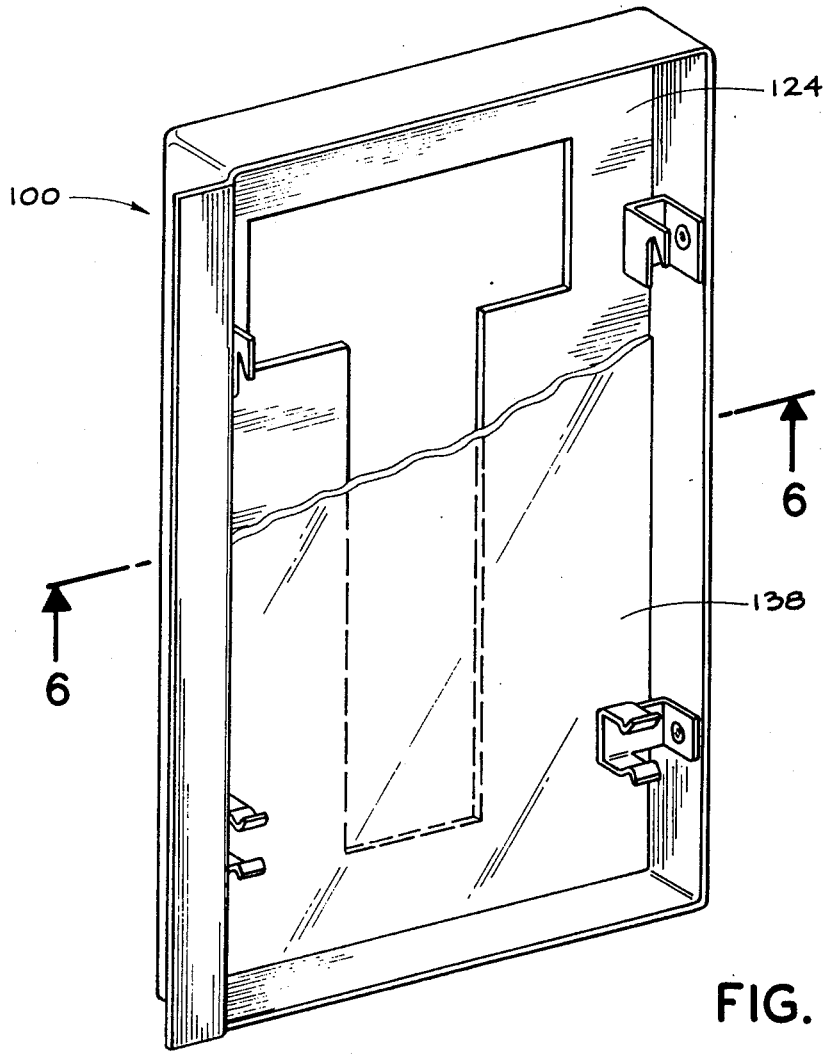
FIG. 5 is a rear perspective view of a letter in accordance with a second embodiment of the present invention.

As required, detailed illustrative embodiments of the invention are disclosed herein. However, it is to be understood that these embodiments merely exemplify the invention which may take forms that are different from the specific illustrative embodiments disclosed. Therefore, specific structural and functional details are not to be interpreted as necessarily limiting, but as a basis for the claims which define the scope of the invention.

Referring to FIG. 1, there is illustrated letters 10 of the present invention mounted on tracks 12 and 14 running horizontally on a marquee 16. The tracks and marquee do not form a part of the invention, but can be constructed so the tracks 12 and 14 are secured to the marquee 16 by means of clips 18. See, in this regard, U.S. Pat. No. 3,574,964. The tracks 12 and 14 have an H-shape in cross-sectional configuration. As illustrated, the letters 10 are each of uniform, rectangular box-like or tray-like configuration with alphabet letters or other indicia 20 defined by an opening 22 formed in the front panel 24 of the letter. The letters are mounted on the track by means of brackets, as described hereinafter in more detail, so as to slide along the track as indicated by the arrow 26 until they abut one another. Additionally, each letter 10 includes a vertical lip 28 extending laterally thereof on one side 30 for overlap engagement with the opposite side 32 of the adjacent letter. As is often the case, the marquee 16 can be formed of translucent material and can be backlighted so that the letters 10 stand out in contrast against the backlit surface of the marquee 16.

In addition to the side walls 30 and 32, each letter 10 includes a bottom wall 34 (FIG. 2) and top wall 36 which are integrally formed with the front panel 24 to define a substantially continuous rim for the front panel 24. The walls 30, 32, 34 and 36 and front panel 24 are formed of opaque material so that as a result of the overlapping relationship of the letters 10, and stencil-like cutout of the indicia 20, the indicia are seen against the contrasting background provided by the opaque material.

The indicia of each letter 10 is further distinguished by means of a color panel 38 which is secured rearwardly of, but adjacent, the front panel 24 as will be described in more detail hereinafter. In the specific embodiment illustrated by FIGS. 1–4, the color panel is removable and a panel of different color can be substituted therefore to provide any desired color to the indicia.

Referring to the letter R shown at 10′, the color panel 38′ in that letter, also serves to support a patch 40 of opaque material to complete the configuration of the letter. Similar considerations apply to letters with indicia representing the letters A, B, D, O, P and Q. With such alphabet letters, of course, each would require their own set of color panels, but the color panels for the alphabet letters P and R would be interchangeable as would the panels for the alphabet letters O and Q.

Referring now to FIGS. 2, 3 and 4, further details of construction of the present letters can be seen. As above indicated, the side walls 30 and 32, bottom wall 34 and top wall 36 are integrally and continuously formed with the front panel 24 to define a tray-like structure. The color panel 38 is secured against the front panel 24 by means of elongate frame members 42, 44, 46 and 48 connected to and coextensive with major length sections of the side, bottom and top walls 30, 32, 34 and 36, respectively. Each frame member is of generally L-shape configuration secured by one leg to the inner surface of the adjacent wall, e.g., with adhesive or the like. The right angle leg of each frame member is somewhat deformed so that the distal edge can accomodate the color panel 38 while its proximal region is secured by adhesive or the like to the inner surface of the front panel adjacent the walls. The distal edges of the frame members define flanges to secure the color panel 38 against the front panel 34. As above indicated, the color panel 38 is flexible and, referring specifically to FIG. 3, it can be bent and inserted between the flange portions of the frame members 42, 44, 46 and 48, as indicated in shadow at 38″ and by the arrow 50. When it is desired to change the color of the letter 10, one need merely remove the color panel 38 and insert a color panel of a different color. Of course, if the color panel as such is to have a patch 40 thereon as illustrated with respect to color panel 38′ of FIG. 1, the substitute color panel will require a similar patch.

As above indicated, each letter 10 is provided with brackets to secure the letter to the track 12 and 14 of the marquee 16. Thus, each letter includes a pair of vertically spaced upper and lower brackets 52 and 54 adjacent the side wall 30 and a pair of similarly vertically spaced upper and lower brackets 56 and 58 adjacent the opposite side wall 32. The brackets 52, 54, 56 and 58 each have a portion projecting rearwardly of the front panel formed to engage the marquee track 12 or 14 at a point from the panel which is a distance greater than the rearward extent of the side walls 30 and 32. With the upper brackets 52 and 56, the engaging portion comprises a hook 60 and 62, respectively. With the lower brackets 54 and 58, the engaging portion includes opposing spring fingers 64 and 66, respectively.

As above indicated, each letter 10 includes a lip 28 which is integrally coextensive with one of the side walls 30 and extends laterally a substantial distance therefrom for overlap with the opposite side wall 32 of a letter. In accordance therewith, and as an aspect of the present invention, the upper and lower brackets 56 and 58 which are adjacent the side wall 32 opposite the lip-bearing side wall 30 are formed so that the marquee-engaging portion, namely the hook portion 62 of the upper bracket 66 and spring fingers 66 of the lower bracket 58, are spaced from the adjacent side wall 32 a distance sufficient to permit overlap with the lip (corresponding to the lip 28) of an adjacent letter. Accordingly, each of these brackets 56 and 58 are formed with a return section 68 and 70, respectively.

Each bracket 52, 54, 56 and 58 is secured to the adjacent side wall through the frame leg sandwiched thereby by means of grommets 72. The brackets 52 and 54 opposite the return brackets 56 and 58, of course, can be formed so that their marquee-engaging portions 60 and 62, respectively, are closely adjacent the side wall 30 thereat.

Figure 6:
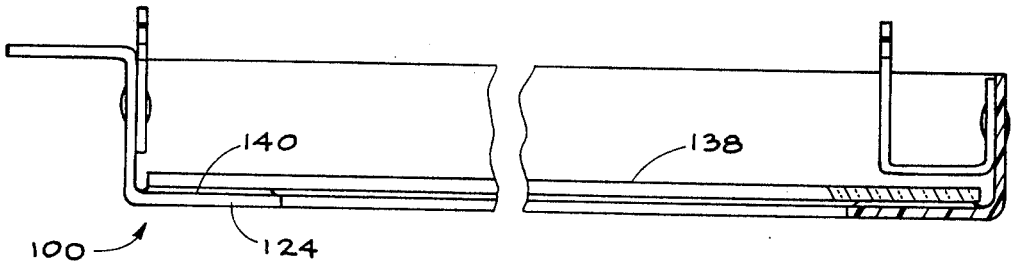
FIG. 6 is a cross-sectional view on line 6—6 of FIG. 5.

Referring now to FIGS. 5 and 6, there is shown a second embodiment of the invention wherein letters 100 are provided which are in most respects identical to the letters 10 of FIGS. 1–4, but wherein frame members are omitted and the color panel 138 is permanently secured to the front panel 124 by means of adhesive 140. The letters of FIGS. 5 and 7 do not have the advantage of permitting replacement of the color panel to change the color of the indicia, but they can be less expensive to manufacture than are the letters of FIGS. 1–4.

Generally, the letters constructed in accordance with the present invention have a side dimension of at least 4 inches and a length of at least 6 inches. In the specific example illustrated, the lip is ¾ inch wide and the letter is about 20 inches long and about 12 inches wide, exclusive of the lip. The color panel is sufficiently rigid as to be self-supporting but is flexible and formed of plastic sheeting which is translucent to light. In the illustration, the sheeting is about 1/32 inches thick, but could be thinner or thicker provided it is self-supporting yet flexible. Of course, with the embodiment illustrated in FIGS. 5 and 6, such structural criteria are not as significant. The tray-like member defined by the front panel 24 and walls 30, 32, 34 and 36, and the lip 28, are integrally formed in one piece of molded plastic, but the unit can be made of metal such as aluminum, or other substance. Additionally, various changes can be made in the present invention without departing from the spirit of the invention as defined by the appended claims.

I claim:

1. A letter for use on a lighted marquee, comprising:

an opaque tray-like member having a front panel, first and second side walls and top and bottom walls integral therewith, each of said walls extending at least a predetermined distance rearwardly from said front panel whereby to project said front panel from said marquee, said front panel being formed with an indicia opening therethrough, said top bottom, first and second side walls defining a substantially continuous rim for said front panel whereby the escape of light from said marquee in the direction of a viewer is substantially precluded;

Flexible translucent color panel interchangeably secured subadjacently of said front panel for providing color for said indicia opening whereby one can selectively highlight said indicia;

a lip integrally coextensive with said first side wall and extending laterally outwardly and parallel to said front panel for a substantial distance therefrom so as to overlap with the second side of a letter of like construction placed immediately adjacent thereto;

brackets connected to said letter, at least one adjacent each of said first and second side walls, each having a portion formed with means to engage said marquee, each said portion projecting rearwardly of said front panel a distance greater than said predetermined distance of said side walls, the bracket adjacent said second side wall being spaced therefrom, towards said first side wall, a distance sufficient to permit substantial overlap with the lip of a letter of like construction placed adjacent thereto, and framing means including flange means on at least one major portion of a pair of opposed walls whereby said panel may be slid between said flange means and said front pane.

2. The letter of claim 1 in which the bracket adjacent said second side wall is spaced a distance at least as great as the lateral extent of said lip.

3. The letter of claim 1 in which said lip extends laterally from said first side wall a distance of at least ¼ inches.

4. The letter of claim 1 in which said brackets comprise upper and lower brackets adjacent each of said first and second side walls.

5. The letter of claim 4 in which said upper brackets each comprise a hook as said engaging portion and said lower brackets each comprise spring fingers as said engaging portion.

6. The letter of claim 1 in which said front panel has a predetermined color visually distinguishable from said color of said color panel and said color panel has adhered to its forward surface within said front panel indicia opening, a patch of opaque material having the same color as said front panel, whereby to make certain indicia more readily recognizable.

* * * * *